US006871854B2

(12) United States Patent
Lin

(10) Patent No.: US 6,871,854 B2
(45) Date of Patent: Mar. 29, 2005

(54) STRATEGIC BOARD GAME

(75) Inventor: Shih-Lun Lin, Taichung (TW)

(73) Assignee: Heng Sheng Enterprises Corp., Taichung (TW)

( * ) Notice: Subject to any disclaimer, the term of this patent is extended or adjusted under 35 U.S.C. 154(b) by 10 days.

(21) Appl. No.: 10/601,018

(22) Filed: Jun. 20, 2003

(65) Prior Publication Data

US 2004/0256801 A1 Dec. 23, 2004

(51) Int. Cl.[7] ..... A63F 3/00
(52) U.S. Cl. ..... 273/258; 273/260
(58) Field of Search ..... 273/260, 261, 273/258, 271; D21/334, 344, 348, 362, 363, D21/364, 368

(56) References Cited

U.S. PATENT DOCUMENTS 682,052 A * 9/1901 Felter ..... 273/261

OTHER PUBLICATIONS

Ex.Parte Breslow 192 USPQ 431.*

* cited by examiner

*Primary Examiner*—Vishu K. Mendiratta
(74) *Attorney, Agent, or Firm*—Frommer Lawrence & Haug LLP; Ronald R. Santucci

(57) ABSTRACT

A strategic board game includes a game board formed with forty-two positioning spaces for placing game pieces. The positioning spaces include first to seventh positioning spaces located on a common circular line and angularly spaced apart from each other such that each of the first to seventh positioning spaces is spaced apart from four other ones of the first to seventh positioning spaces by an adjacent pair of the first to seventh positioning spaces. Each of the first to seventh positioning spaces is connected to each of the four other ones of the first to seventh positioning spaces by four of a total of fourteen connecting lines radiating from the first to seventh positioning spaces. The fourteen connecting lines intersect each other at thirty-five intersection points, where the remaining positioning spaces are respectively disposed.

10 Claims, 14 Drawing Sheets

STRATEGIC BOARD GAME

BACKGROUND OF THE INVENTION

1. Field of the Invention

The invention relates to a game, more particularly to a strategic board game.

2. Description of the Related Art

Conventional strategic board games, such as checkers and chess, involve two players who move their game pieces across a game board in an attempt to capture or trap the game pieces of the other player.

SUMMARY OF THE INVENTION

The main object of the present invention is to provide a strategic board game in which two players take turns in placing their game pieces on a game board such that the player whose game pieces on the game board are the first to meet a winning condition set forth in a predetermined set of game rules is declared the winner of the game.

Another object of the present invention is to provide a strategic board game that can also be used to train mental computation ability of the players.

According to the present invention, a strategic board game comprises a game board having a playing region formed with forty-two positioning spaces, and a plurality of game pieces to be disposed on the positioning spaces, respectively.

The positioning spaces include first to seventh positioning spaces that are located on a common circular line and that are angularly spaced apart from each other such that each of the first to seventh positioning spaces is located between an adjacent pair of the first to seventh positioning spaces and such that each of the first to seventh positioning spaces is spaced apart from four other ones of the first to seventh positioning spaces by the adjacent pair of the first to seventh positioning spaces. Each of the first to seventh positioning spaces is connected to each of the four other ones of the first to seventh positioning spaces by four of a total of fourteen connecting lines radiating from the first to seventh positioning spaces. The fourteen connecting lines intersect each other at thirty-five intersection points. The positioning spaces further include eighth to forty-second positioning spaces disposed respectively at the intersection points.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
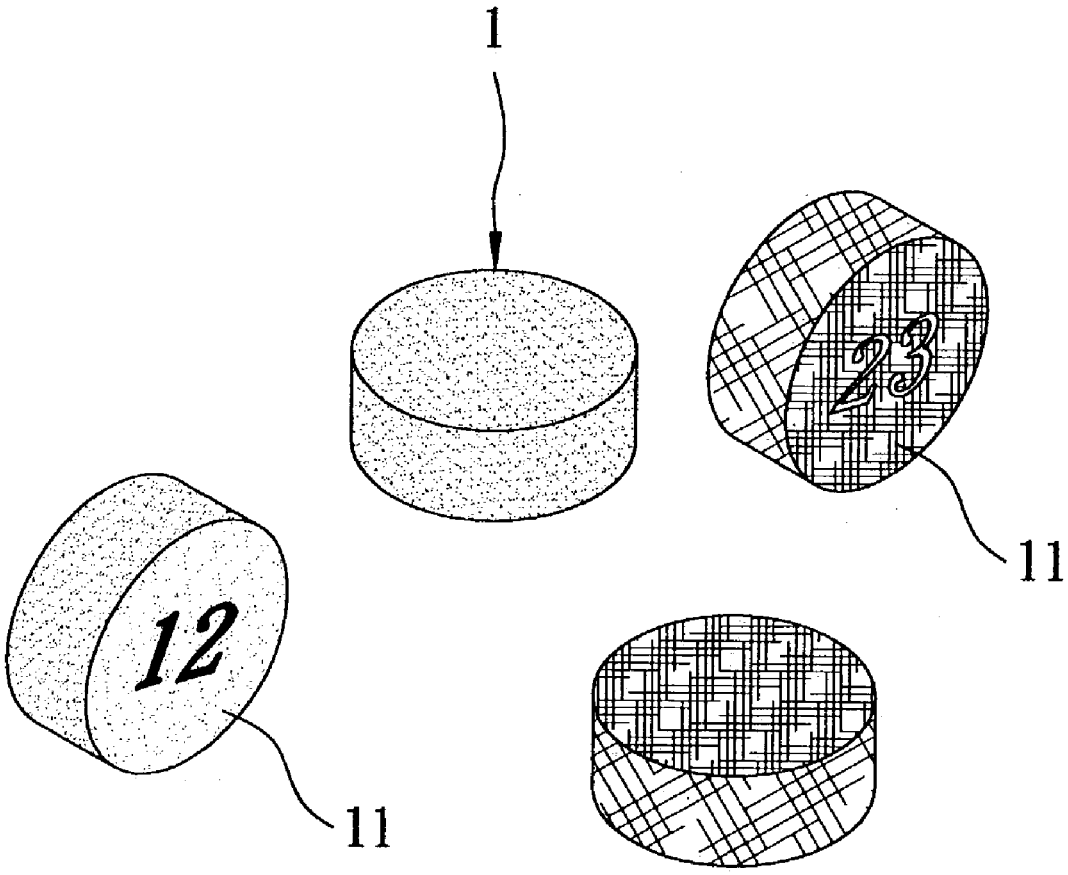
FIG. 1 illustrates a set of game pieces of the preferred embodiment of a strategic board game according to the present invention.
Figure 2:
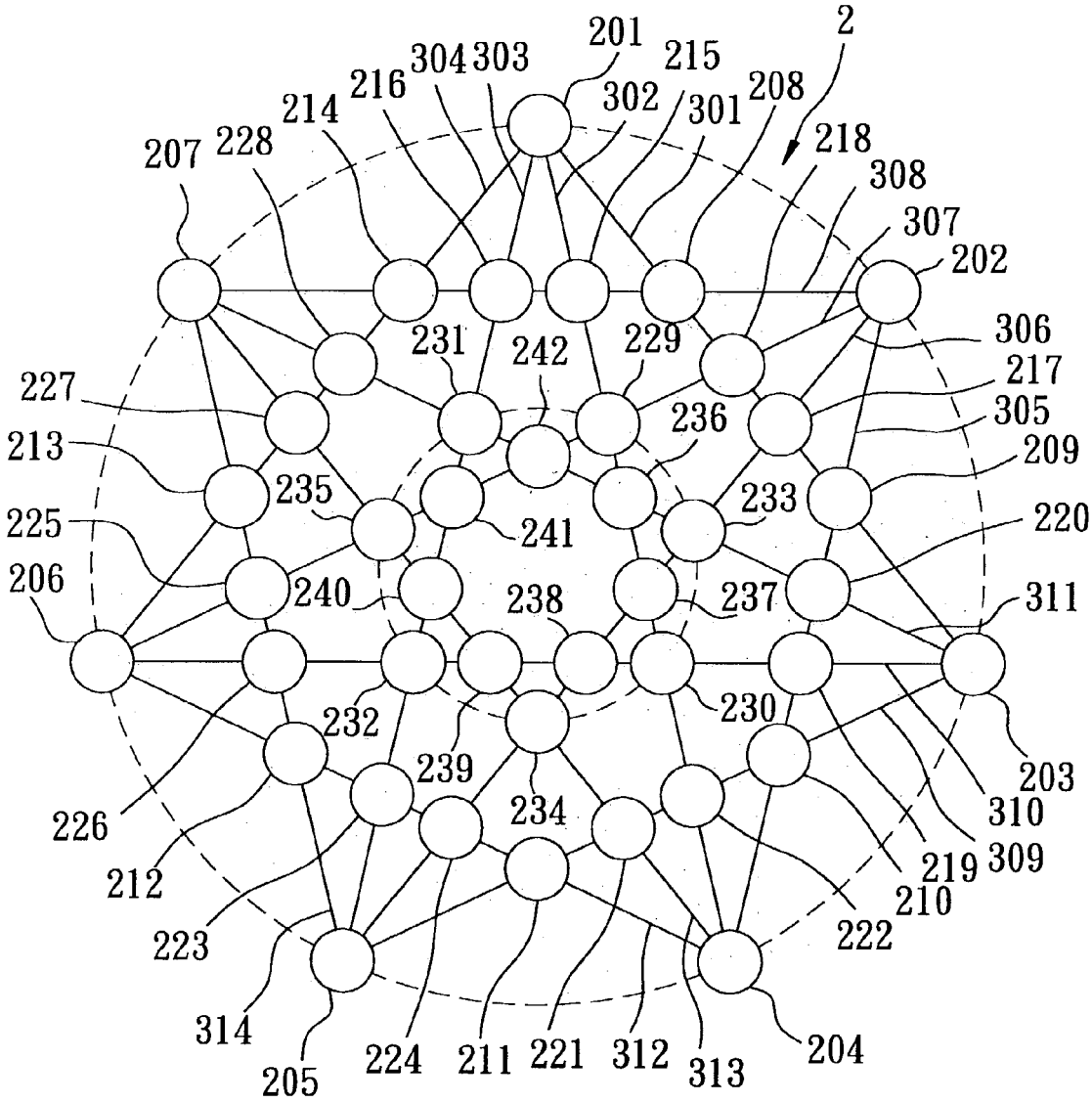
FIG. 2 is a schematic view to illustrate a playing region of a game board of the preferred embodiment.

Referring to FIGS. 1 and 2, the preferred embodiment of the strategic board game according to the present invention is shown to comprise a plurality of game pieces 1 and a game board 2.

The strategic board game includes a total of forty-two game pieces 1 equally divided into first and second sets. In the preferred embodiment, the twenty-one game pieces 1 in the first set are distinguished by color from the twenty-one game pieces 1 in the second set. Moreover, each of the game pieces 1 in the first set has a printed side 11 printed with a respective odd number that is in the range from 1 to 41 and that is distinct from those printed on other ones of the game pieces 1 in the first set. Each of the game pieces 1 in the second set has a printed side 11 printed with a respective even number that is in the range from 2 to 42 and that is distinct from those printed on other game pieces 1 in the second set.

Figure 3:
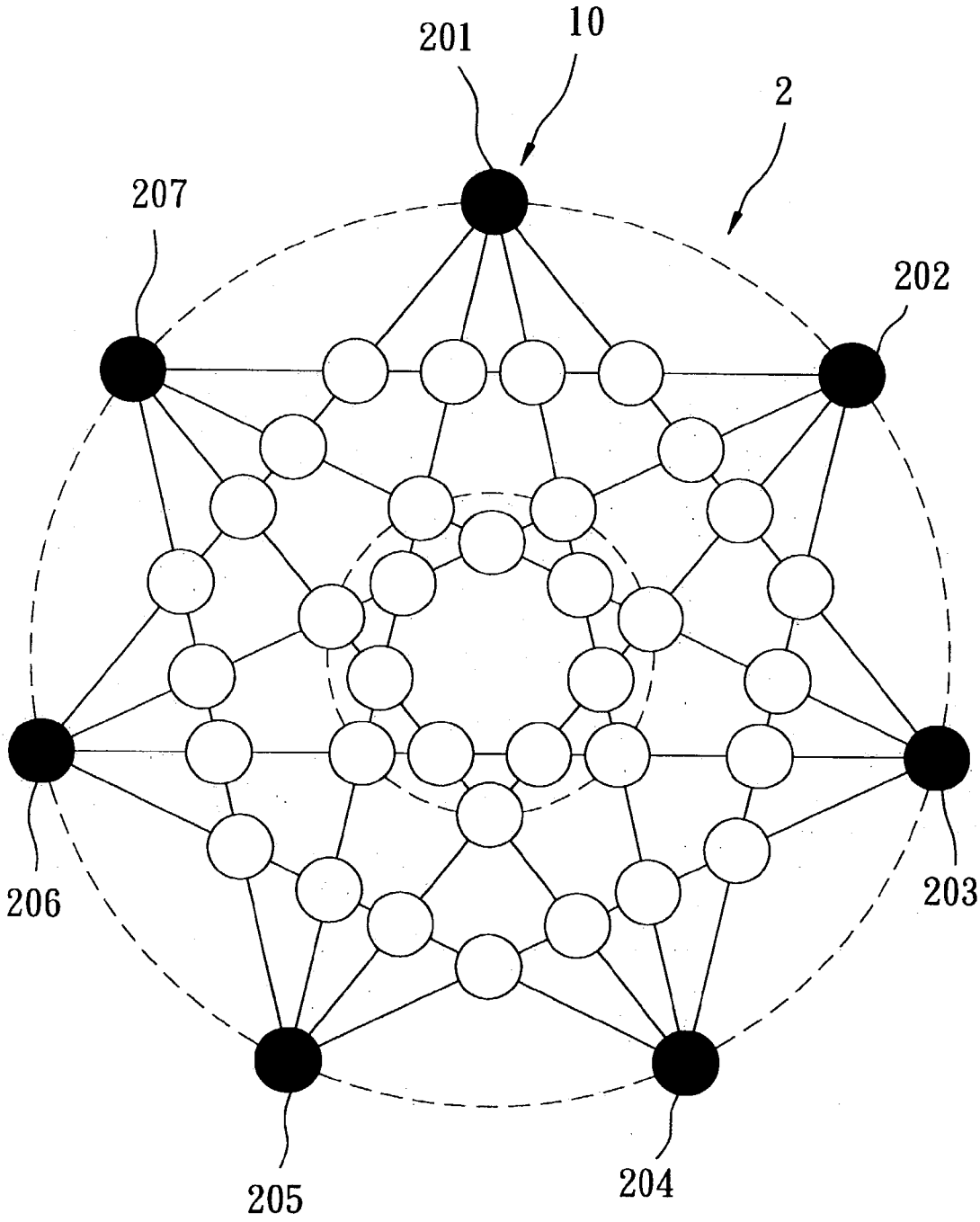
FIGS. 3 to 11 respectively illustrate exemplary winning patterns defined in a predetermined set of game rules of the strategic board game of this invention.

The game board 2 has a playing region formed with forty-two positioning spaces 201–242. The positioning spaces 201–242 include first to seventh positioning spaces 201–207 that are located on a common outer circular line and that are equiangularly spaced apart from each other such that each of the first to seventh positioning spaces 201–207 is located between an adjacent pair of the first to seventh positioning spaces 201–207 and such that each of the first to seventh positioning spaces 201–207 is spaced apart from four other ones of the first to seventh positioning spaces 201–207 by the adjacent pair of the first to seventh positioning spaces 201–207. In the preferred embodiment, the first to seventh positioning spaces 201–207 form a first winning pattern 10 defined in a predetermined set of game rules, as best shown in FIG. 3. Each of the first to seventh positioning spaces 201–207 is connected to each of the four other ones of the first to seventh positioning spaces 201–207 by four of a total of fourteen connecting lines 301–314 radiating from the first to seventh positioning spaces 201–207. The fourteen connecting lines 301–314 intersect each other at thirty-five intersection points. The positioning spaces 201–242 further include eighth to forty-second positioning spaces 208–242 disposed respectively at the intersection points.

As shown in FIG. 2, the first to seventh positioning spaces 201–207 are consecutively arranged in a clockwise direction starting from an uppermost part of the playing region of the game board 2. The first positioning space 201 is connected to the third to sixth positioning spaces 203–206 by first to fourth ones of the connecting lines 301–304, respectively. The second positioning space 202 is connected to the fourth to seventh positioning spaces 204–207 by fifth to eighth ones of the connecting lines 305–308. The third positioning space 203 is further connected to the fifth to seventh positioning spaces 205–207 by ninth to eleventh ones of the connecting lines 309–311. The fourth positioning space 204 is further connected to the sixth and seventh positioning spaces 206, 207 by twelfth and thirteenth ones of the connecting lines 312, 313. The fifth positioning space 205 is further connected to the seventh positioning space 207 by a fourteenth one of the connecting lines 314.

Figure 4:
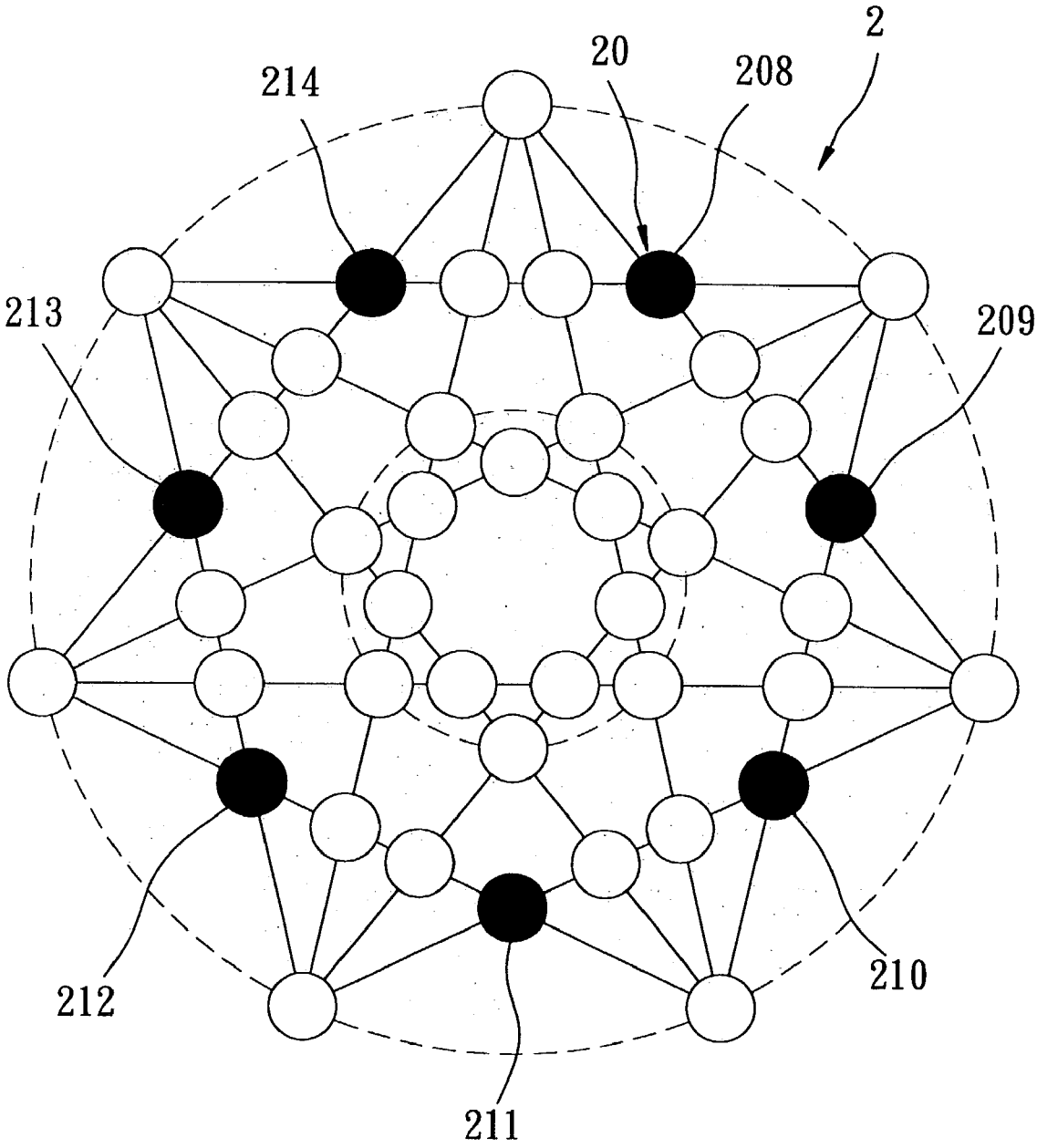

The eighth to fourteenth positioning spaces 208–214 are respectively disposed at the intersection points of the first, fourth, fifth, eighth, ninth, twelfth and fourteenth ones of the connecting lines 301, 304, 305, 308, 309, 312, 314. The eighth to fourteenth positioning spaces 208–214 form seven corners of an outer heptagon surrounded by the common outer circular line on which the first to seventh positioning spaces 201–207 are disposed, and cooperate to form a second winning pattern 20 defined in the predetermined set of game rules, as best shown in FIG. 4.

Figure 5:
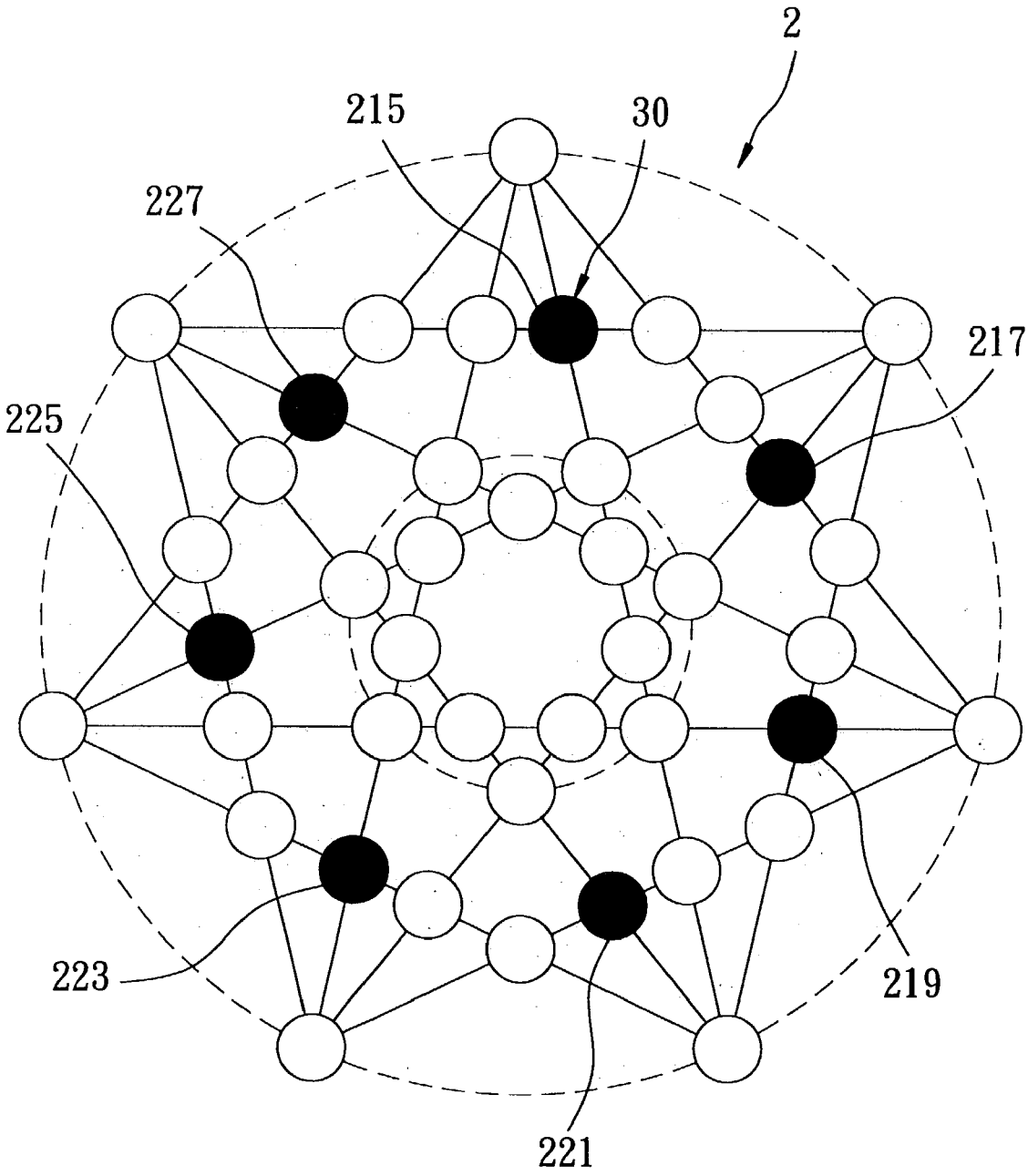
Figure 6:
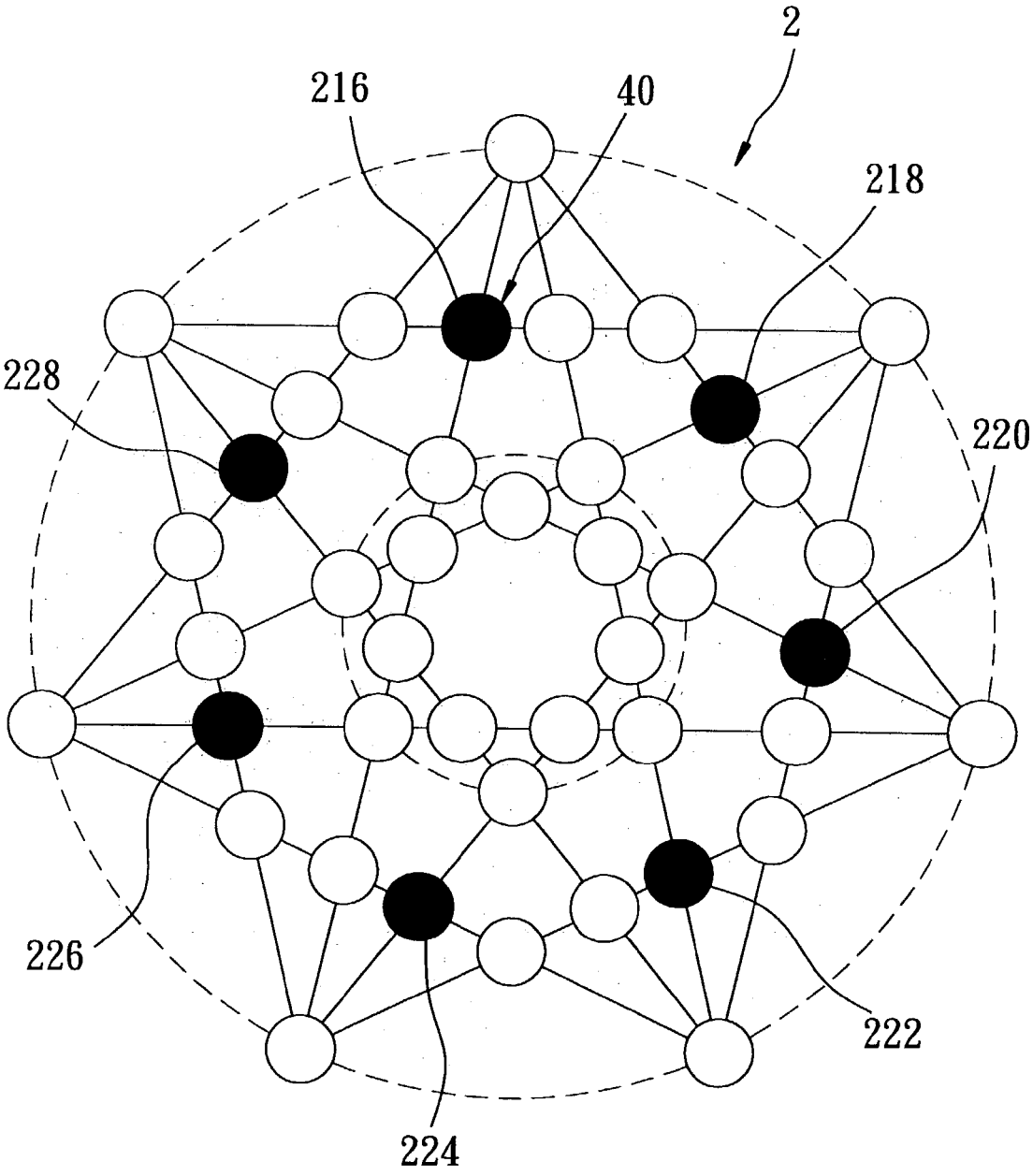

The fifteenth to twenty-eighth positioning spaces 215–228 are respectively disposed at the intersection points of the first, fourth, fifth, eighth, ninth, twelfth and fourteenth ones of the connecting lines 301, 304, 305, 308, 309, 312, 314 with the second, third, sixth, seventh, tenth, eleventh and thirteenth ones of the connecting lines 302, 303, 306, 307, 310, 311, 313. Particularly, the fifteenth and sixteenth positioning spaces 215, 216 are disposed between the eighth and fourteenth positioning spaces 208, 214, the seventeenth and eighteenth positioning spaces 217, 218 are disposed between the eighth and ninth positioning spaces 208, 209, the nineteenth and twentieth positioning spaces 219, 220 are disposed between the ninth and tenth positioning spaces 209, 210, the twenty-first and twenty-second positioning spaces 221, 222 are disposed between the tenth and eleventh positioning spaces 210, 211, the twenty-third and twenty-fourth positioning spaces 223, 224 are disposed between the eleventh and twelfth positioning spaces 211, 212, the twenty-fifth and twenty-sixth positioning spaces 225, 226 are disposed between the twelfth and thirteenth positioning spaces 212, 213, and the twenty-seventh and twenty-eighth positioning spaces 227, 228 are disposed between the thirteenth and fourteenth positioning spaces 213, 214. In the preferred embodiment, the fifteenth, seventeenth, nineteenth, twenty-first, twenty-third, twenty-fifth and twenty-seventh positioning spaces 215, 217, 219, 221, 223, 225, 227 cooperate to form a third winning pattern 30 defined in the predetermined set of game rules, as best shown in FIG. 5. Moreover, the sixteenth, eighteenth, twentieth, twenty-second, twenty-fourth, twenty-sixth and twenty-eighth positioning spaces 216, 218, 220, 222, 224, 226, 228 cooperate to form a fourth winning pattern 40 defined in the predetermined set of game rules, as best shown in FIG. 6.

Figure 7:
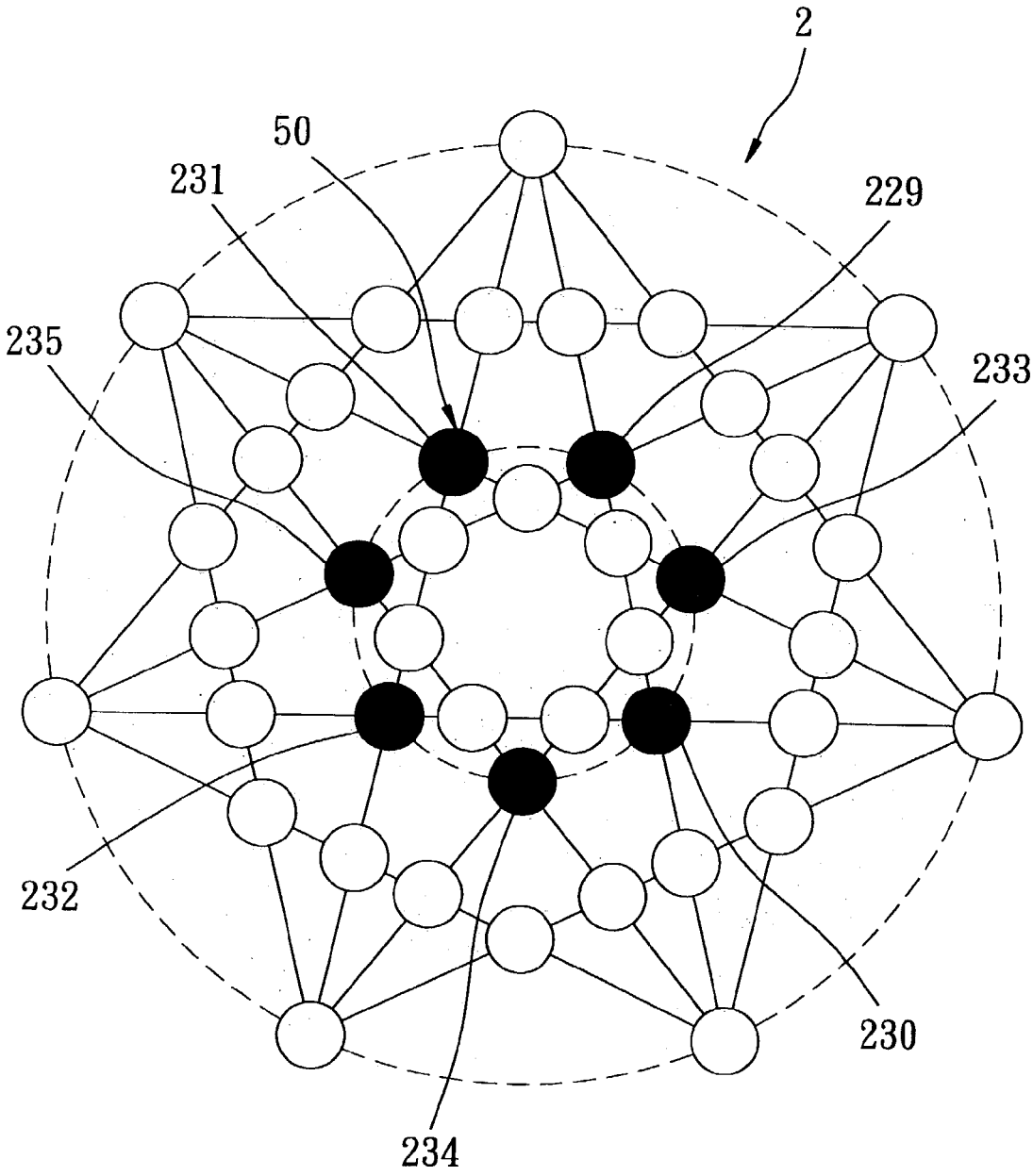

The twenty-ninth and thirtieth positioning spaces 229, 230 are respective disposed at the intersection points of the second one of the connecting lines 302 with the seventh and tenth ones of the connecting lines 307, 310. The thirty-first and thirty-second positioning spaces 231, 232 are respectively disposed at the intersection points of the third one of the connecting lines 303 with the eleventh and tenth ones of the connecting lines 311, 310. The thirty-third and thirty-fourth positioning spaces 233, 234 are respectively disposed at the intersection points of the sixth one of the connecting lines 306 with the eleventh and thirteenth ones of the connecting lines 311, 313. The thirty-fifth positioning space 235 is disposed at the intersection point of the seventh one of the connecting lines 307 with the thirteenth one of the connecting lines 313. The twenty-ninth to thirty-fifth positioning spaces 229–235 are located on a common inner circular line surrounded by the outer heptagon on which the eighth to fourteenth positioning spaces 208–214 are disposed, are equiangularly spaced apart from each other, and cooperate to form a fifth winning pattern 50 defined in the predetermined set of game rules, as best shown in FIG. 7.

Figure 8:
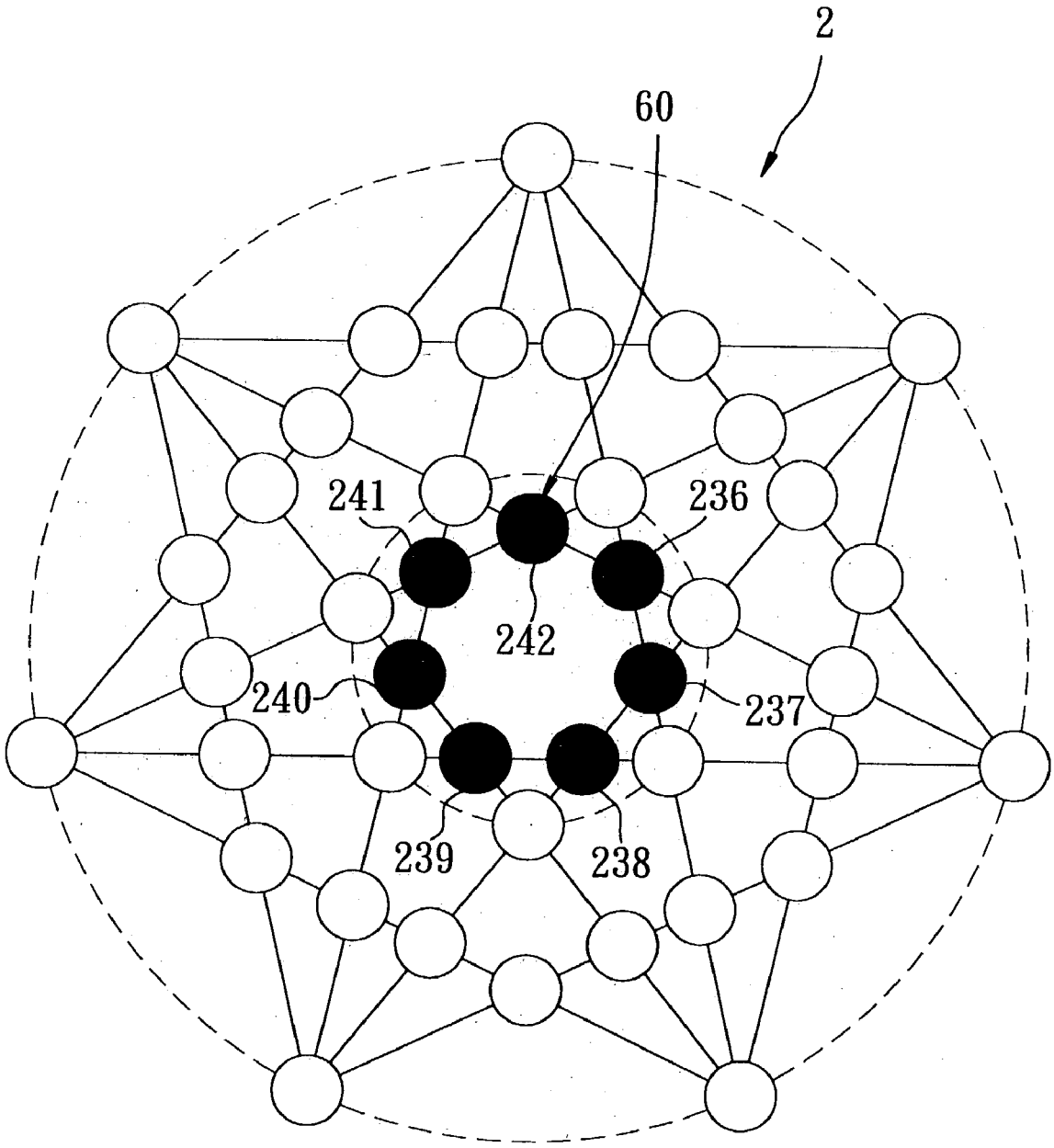

The thirty-sixth to forty-second positioning spaces 236–242 are respectively disposed at the intersection point of the second one of the connecting lines 302 with the eleventh one of the connecting lines 311, the second one of the connecting lines 302 with the sixth one of the connecting lines 306, the sixth one of the connecting lines 306 with the tenth one of the connecting lines 310, the tenth one of the connecting lines 310 with the thirteenth one of the connecting lines 313, the third one of the connecting lines 303 with the thirteenth one of the connecting lines 313, the third one of the connecting lines 303 with the seventh one of the connecting lines 307, and the seventh one of the connecting lines 307 with the eleventh one of the connecting lines 311. The thirty-sixth to forty-second positioning spaces 236–242 forms even corners of an inner heptagon surrounded by the common inner circular line on which the twenty-ninth to thirty-fifth positioning spaces 201–207 are disposed, and cooperate to form a sixth winning pattern 60 defined in the predetermined set of game rules, as best shown in FIG. 8.

In the preferred embodiment, the positioning spaces 201–242 are printed with a particular color in accordance with the corresponding one of the winning patterns 10–60.

Figure 9:
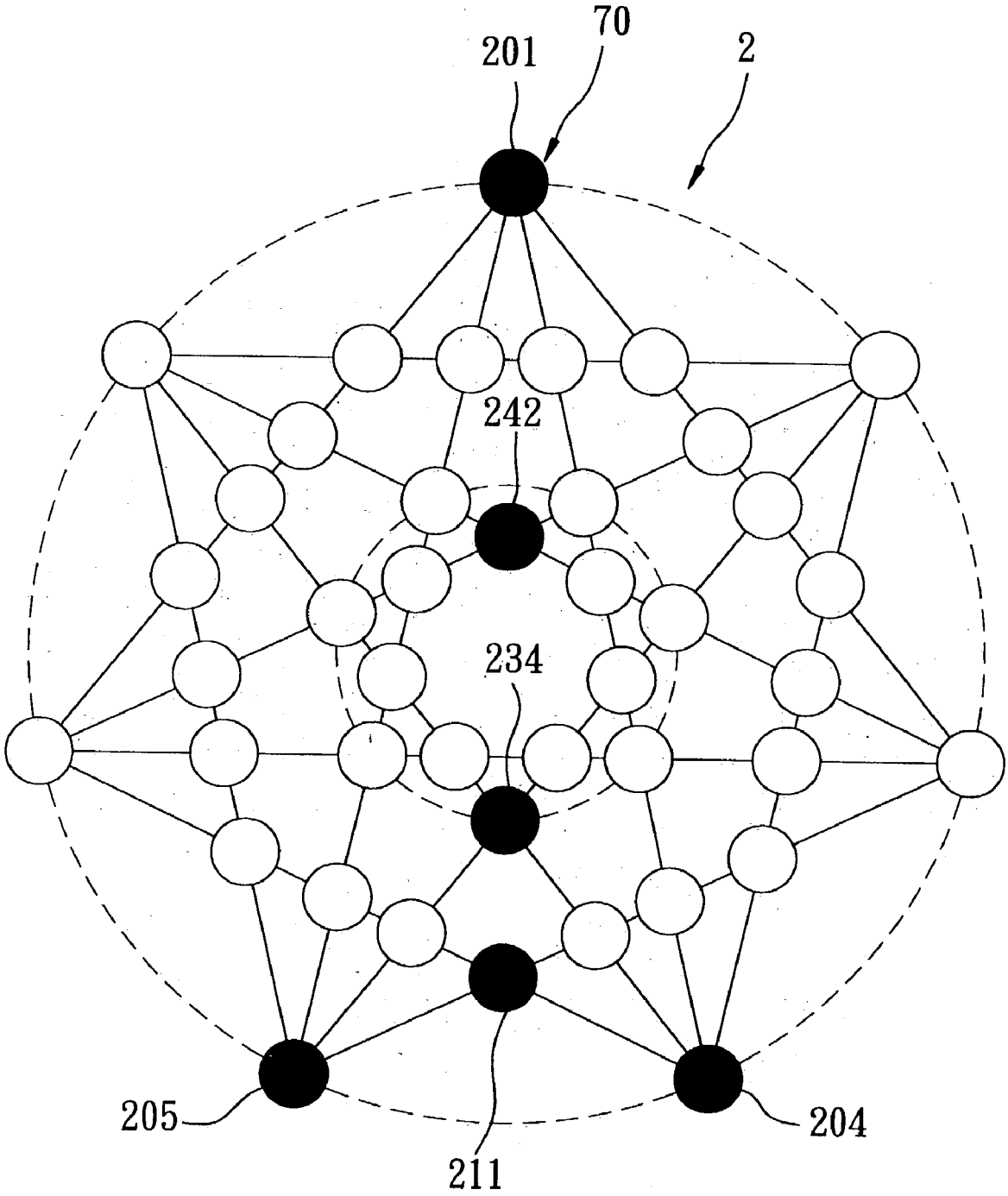
Figure 10:
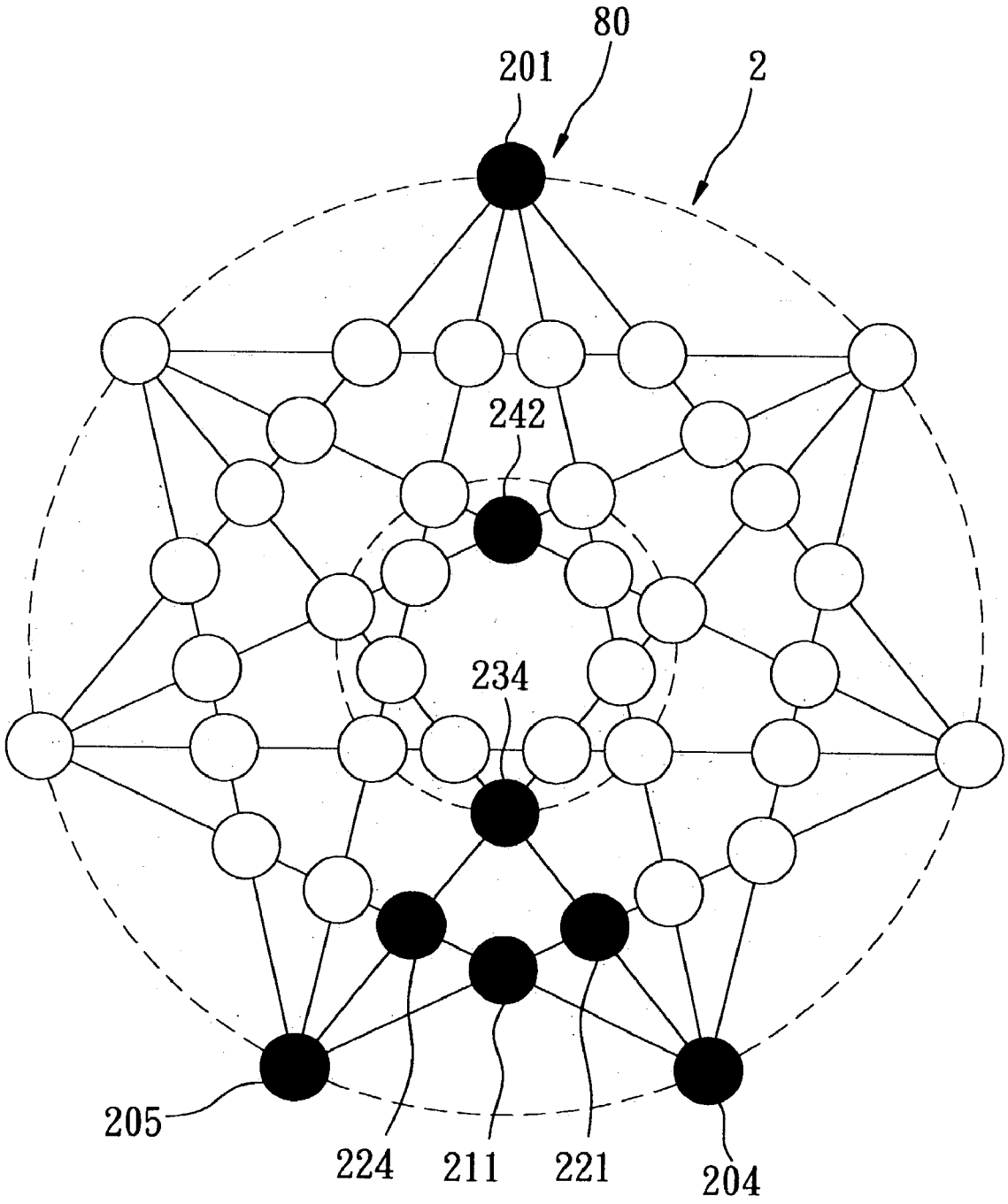
Figure 11:
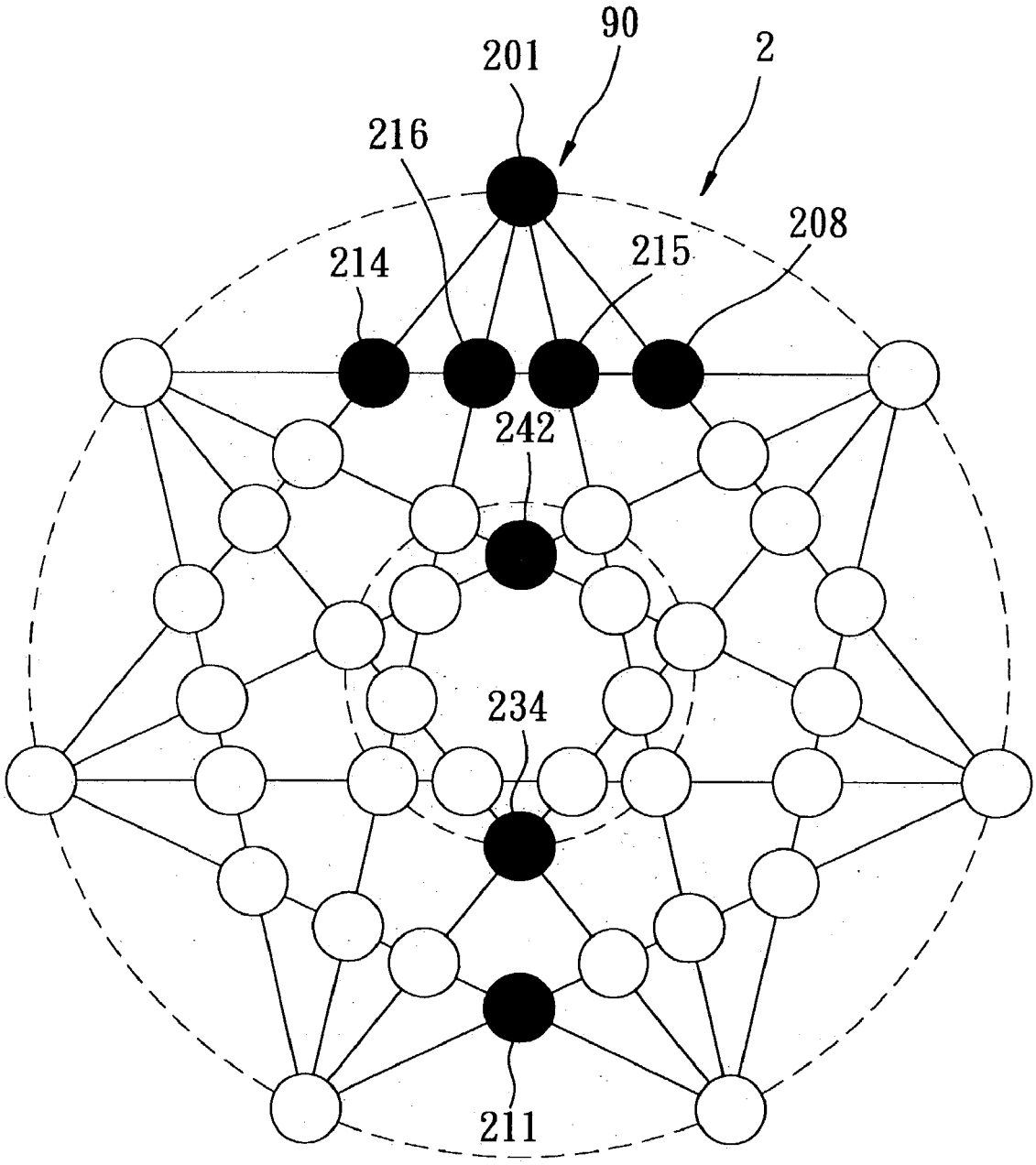

Other winning patterns may be defined in the predetermined set of game rules of the strategic board game of this invention. As shown in FIG. 9, a six-space rocket formation 70 is formed by the first, fourth, fifth, eleventh, thirty-fourth and forty-second positioning spaces 201, 204, 205, 211, 234, 242. As shown in FIG. 10, an eight-space rocket formation 80 is formed by the first, fourth, fifth, eleventh, twenty-first, twenty-fourth, thirty-fourth and forty-second positioning spaces 201, 204, 205, 211, 221, 224, 234, 242. As shown in FIG. 11, an eight-space cross formation 90 is formed by the first, eighth, eleventh, fourteenth, fifteenth, sixteenth, thirty-fourth and forty-second positioning spaces 201, 208, 211, 214, 215, 216, 234, 242. A winning pattern can also be formed by the set of the positioning spaces 201–242 disposed in any one of the connecting lines 301–314.

Figure 12:
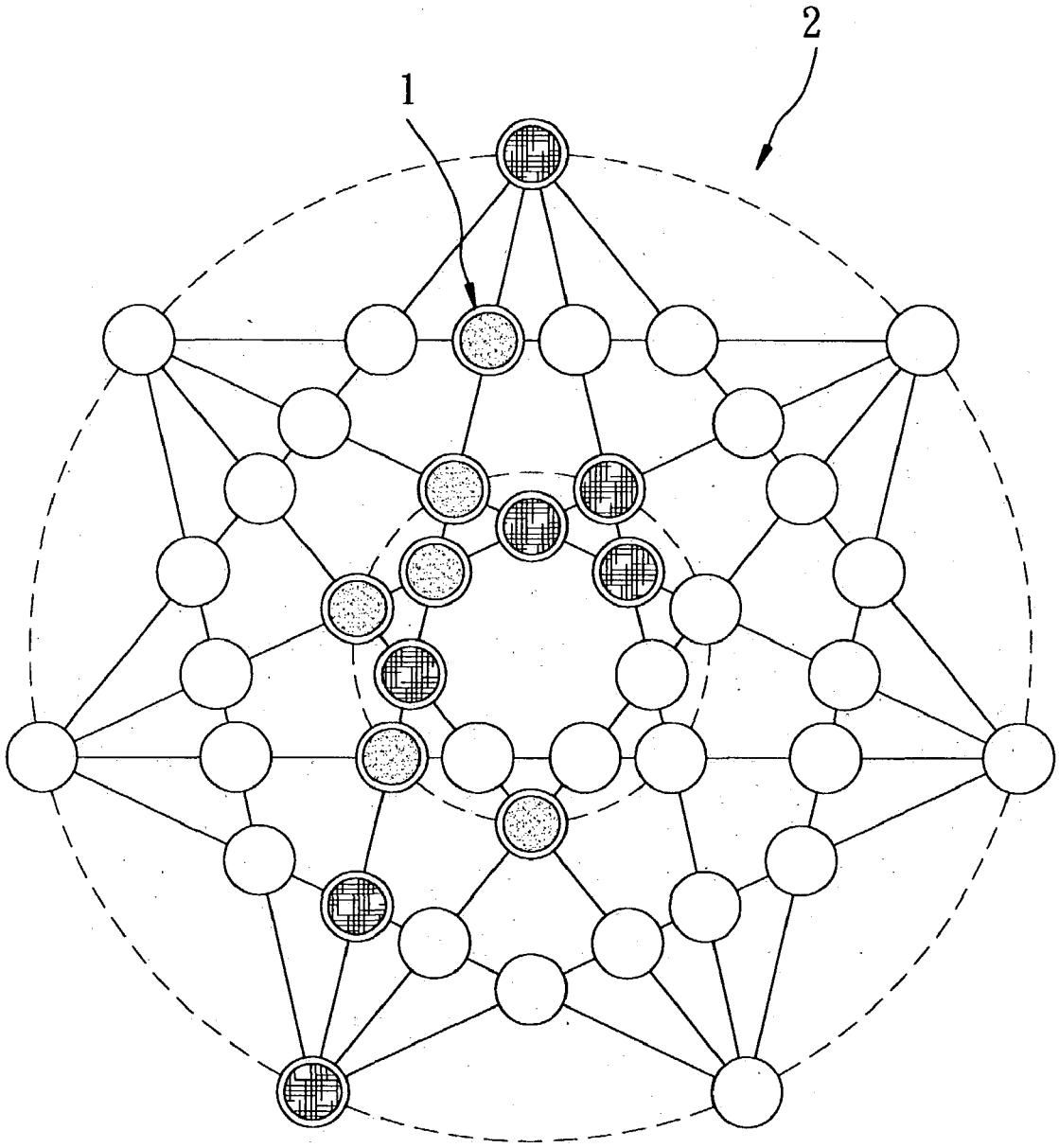
FIG. 12 is a schematic view to illustrate one way of playing the strategic board game of the preferred embodiment.

FIG. 12 illustrates one way of playing the strategic board game of the preferred embodiment. In the example of FIG. 12, each of two players is assigned with a respective one of the first and second sets of the game pieces 1 to begin the game. The players then take turns in placing their game pieces 1 one at a time on the positioning spaces 201–242 of the playing region of the game board 2, with the printed side 11 of the game pieces 1 facing downwardly. The player, whose game pieces 1 on the playing region of the game board 2 are the first to meet a winning condition set forth in the predetermined set of game rules, is declared the winner of the game. Particularly, the winning condition is one where the game pieces 1 of the same player on the playing region of the game board 2 form any one of the aforesaid exemplary winning patterns defined in the game rules.

To increase the complexity of the game, the winning patterns may be assigned with different rankings. In the preferred embodiment, each of the winning patterns is formed from six to eight ones of the positioning spaces 201–242. The winning patterns formed from six of the positioning spaces 201–242, such as the pattern shown in FIG. 9, are ranked higher than those formed from seven of the positioning spaces 201–242, such as those shown in FIGS. 3 to 8. In addition, the winning patterns formed from seven of the positioning spaces 201–242 are ranked higher than those formed from eight of the positioning spaces 201–242, such as those shown in FIGS. 10 and 11. The player whose game pieces 1 on the playing region of the game board 2 are the first to form a highest-ranked one of the winning patterns, i.e., those formed from six of the positioning spaces 201–242, is declared the winner of the game. However, when the game pieces 1 of the first player on the playing region of the game board 2 are the first to form a lower-ranked one of the winning patterns, such as one formed from eight of the positioning spaces 201–242, the second player is given an opportunity to make his game pieces 1 on the playing region of the game board 2 form a higher-ranked one of the winning patterns, such as one formed from six or seven of the positioning spaces 201–242. The second player is declared the winner of the game if his game pieces 1 are able to form the higher-ranked one of the winning patterns. Otherwise, the first player is declared the winner of the game.

Figure 13:
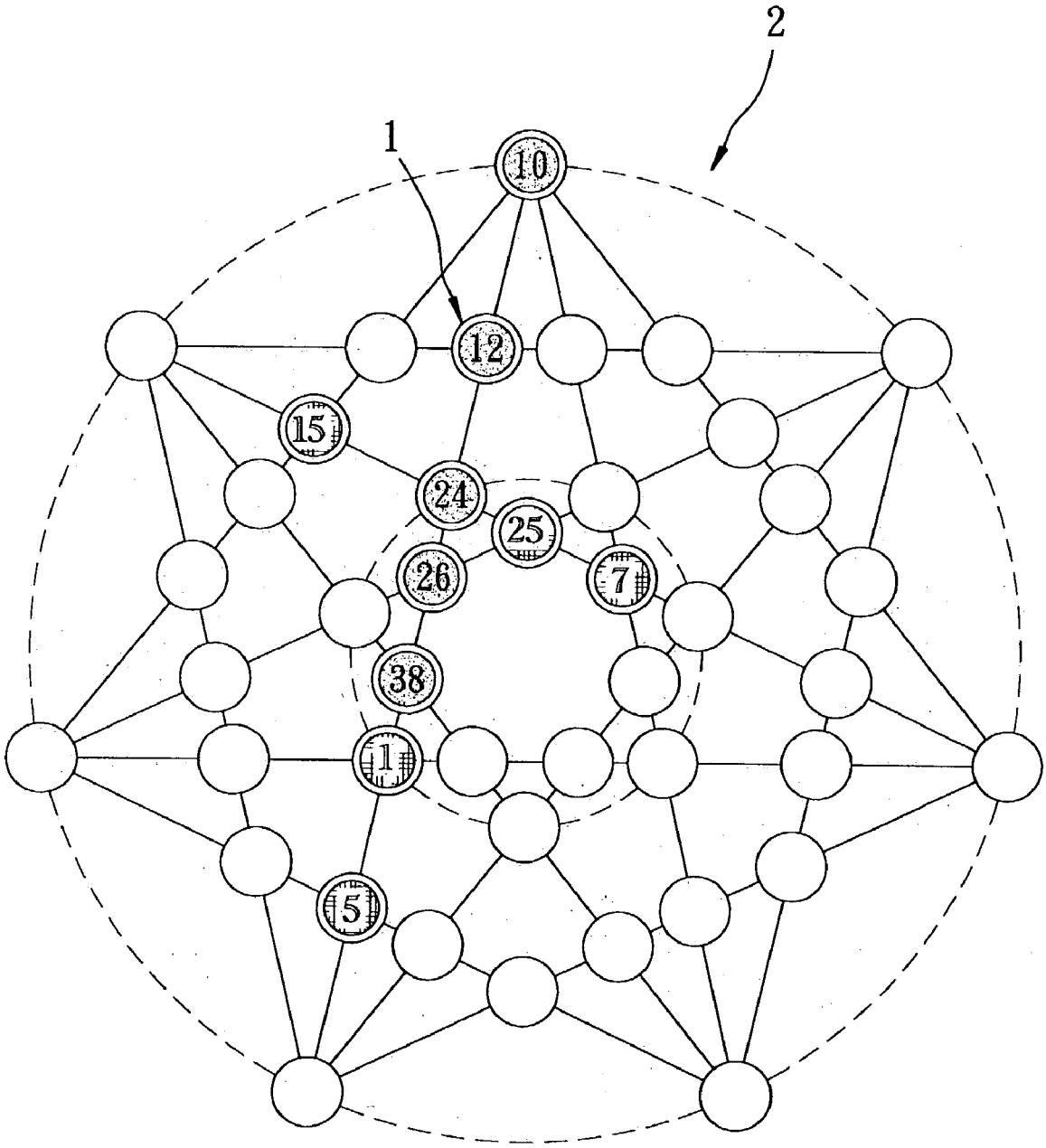
FIG. 13 is a schematic view to illustrate another way of playing the strategic board game of the preferred embodiment.

FIG. 13 is a schematic view to illustrate another way of playing the strategic board game of the preferred embodiment. In the example of FIG. 13, each of two players is also assigned with a respective one of the first and second sets of the game pieces 1 to begin the game. The players then take turns in placing their game pieces 1 one at a time on the positioning spaces 201–242 of the playing region of the game board 2, but with the printed side 11 of the game pieces 1 facing upwardly. The player, whose game pieces 1 on the playing region of the game board 2 are the first to meet a winning condition set forth in the predetermined set of game rules, is declared the winner of the game. Particularly, the winning condition is one where the game pieces 1 of the same player on the playing region of the game board 2 fill any six of the positioning spaces 201–242 that form any one of the aforesaid exemplary winning patterns, with the sum of the numbers printed on the game pieces 1 that fill the six positioning spaces 201–242 being equal to a predetermined total, such as 100.

In the example of FIG. 13, when all of the positioning spaces 201–242 of the playing region of the game board 2 are filled by the game pieces 1 of the two players, and the game pieces 1 of each of the two players are unable to fulfill the winning condition where the sum of the numbers printed on the game pieces 1 that fill six of the positioning spaces 201–242 in any one of the winning patterns is equal to the predetermined total, the winning condition is changed to one where the game pieces 1 of the same player on the playing region of the game board 2 fill any six of the positioning spaces 201–242 that form any one of the exemplary winning patterns defined in the game rules.

In the example of FIG. 13, because playing the game involves making mental computations so as to determine whether the winning condition, where the sum of the numbers printed on the game pieces 1 that fill six of the positioning spaces 201–242 in any one of the exemplary winning patterns is equal to the predetermined total, exists, mental computation ability of the players are trained as well.

Figure 14:
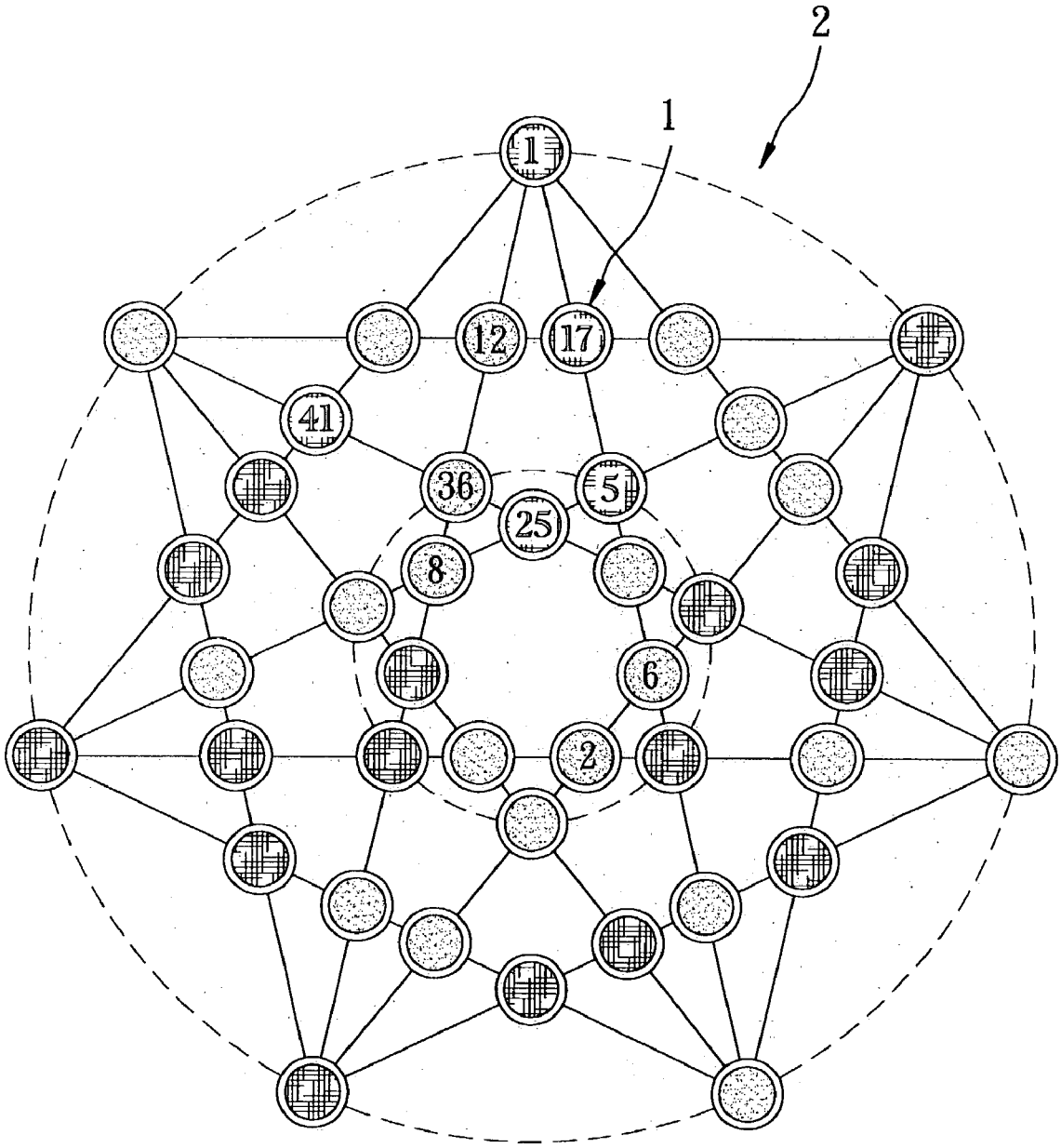
FIG. 14 is a schematic view to illustrate yet another way of playing the strategic board game of the preferred embodiment.

FIG. 14 is a schematic view to illustrate yet another way of playing the strategic board game of the preferred embodiment. In the example of FIG. 14, the first and second sets of the game pieces 1 are randomly placed on the positioning spaces 201–242 of the playing region of the game board 2, with the printed side of each of the game pieces 1 facing downwardly, to begin the game. Each of at least two players then take turns in upturning the game pieces 1 on the positioning spaces 201–242 one at a time. The player who is the first to upturn one of the game pieces 1 that cooperates with other previously upturned ones of the game pieces 1 to form a winning set of the game pieces 1, in which the game pieces 1 in the winning set are disposed on the positioning spaces 201–242 that form any one of the aforesaid exemplary winning patterns defined in the game rules, and in which the sum of the numbers printed on the game pieces 1 in the winning set is equal to a predetermined total, such as 100, is declared the winner of the game.

It is apparent to those skilled in the art that the strategic board game of this invention can be implemented in a video game, arcade game or any other computer-based system having a visual display, where the player can play against a machine or against another player. It is also applicable to network games, where participants can play against each other over a computer network or phone lines. When applied to a video game, arcade game or computer-based system, the strategic board game of this invention would be embodied in software, firmware and/or hardware. Any software code capable of implementing the rules of the strategic board game can be used. Additionally, the display of the video game, arcade game or computer-based system may present the game pieces 1 and the game board 2 of the strategic board game of this invention in a two-dimensional or three-dimensional format.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A strategic board game comprising: a game board comprising a playing region formed with forty-two positioning spaces, the positioning spaces comprising first to seventh positioning spaces located on a common circular line and are equiangularly spaced apart from each other, wherein each of the first to seventh positioning spaces is connected to each of four of the first to seventh positioning spaces not including two immediate adjacent positioning spaces by four of a total of fourteen connecting lines that radiate from the first to seventh positioning spaces, wherein the fourteen connecting lines intersect each other at thirty-five intersection points, wherein the positioning spaces further comprise eighth to forty-second positioning spaces disposed respectively at the intersection points, said strategic game board further comprising a plurality of game pieces to be disposed on the positioning spaces, wherein the game pieces include first and second sets of the game pieces the game pieces in the first set being distinguishable from the game pieces in the second set, wherein each of the game pieces in the first set has a printed side printed with a respective odd number that is in the range from 1 to 41 and that is distinct from those printed on other game pieces in the second set, and wherein each of the game pieces in the second set having a printed side printed with a respective even number that is in the range from 2 to 42 and that is distinct from those printed on other game pieces in the first set.

2. The strategic board game as claimed in claim 1, wherein the game is adapted to be played by two players, who are respectively assigned with the first and second sets of the game pieces and who take turns in placing their game pieces one at a time on the positioning spaces of the playing region of the game board, and wherein one of the two players, whose game pieces on the playing region of the game board are the first to meet a winning condition set forth in a predetermined set of game rules is declared the winner of the game.

3. The strategic board game as claimed in claim 2, wherein the winning condition is one where the game pieces of one of the players on the playing region of the game board form any one of a plurality of predetermined winning patterns defined in the game rules.

4. The strategic board game as claimed in claim 3, wherein the predetermined winning patterns are assigned with different rankings, wherein one of the two players, whose game pieces on the playing region of the game board are the first to form a highest-ranked winning patterns is declared the winner of the game, and wherein, when the game pieces of one of the two players on the playing region of the game board are the first to form a lower-ranked winning patterns, the other of the two players is given an opportunity to make his game pieces on the playing region of the game board form a high-ranked winning patterns, such that the other of the two players is declared the winner of the game if his game pieces are able to form the higher-ranked winning patterns, and such that the one of the two players is declared the winner of the game if otherwise.

5. The strategic board game as claimed in claim 4, wherein each of the winning patterns is formed from six to eight of the positioning spaces, wherein the winning patterns formed from six of the positioning spaces is ranked higher than those formed from seven of the positioning spaces, and wherein the winning patterns formed from seven of the positioning spaces are ranked higher than those formed from eight of the positioning spaces.

6. The strategic board game as claimed in claim 1, wherein the game is played by two players, who are respectively assigned with the first and second sets of the game pieces and who take turns in placing their game pieces one at a time on the positioning spaces of the playing region of the game board, with the printed side of each of the game pieces facing upwardly, wherein one of the two players, whose game pieces on the playing region of the game board are the first to meet a winning condition set forth in a predetermined set of game rules, being declared the winner of the game, wherein the winning condition is one where the game pieces of the one of the players on the playing region of the game board fill any six of the positioning spaces that form any one of a plurality of predetermined winning patterns defined in the game rules, with the sum of the numbers printed on the game pieces that fill any six of the positioning spaces being equal to a predetermined total.

7. The strategic board game as claimed in claim 6, wherein each of the first and second sets includes twenty-one of the game pieces.

8. The strategic board game as claimed in claim 6, wherein the predetermined total is 100.

9. The strategic board game as claimed in claim 6, wherein, when all of the positioning spaces of the playing region of the game board are filled by the game pieces of the two players, and the game pieces of each of the two players are unable to fulfill the winning condition where the sum of the numbers printed on the game pieces that fill said any six of the positioning spaces is equal to the predetermined total, the winning condition is changed to one where the game pieces of the same one of the players on the playing region of the game board fill any six of the positioning spaces of the game board that form any one of the predetermined winning patterns defined in the game rules.

10. The strategic game board as claimed in claim 1, wherein the game pieces in the first set are distinguishable from the game pieces in the second set by color.

* * * * *